US011266890B2

(12) United States Patent
Cavill et al.

(10) Patent No.: US 11,266,890 B2
(45) Date of Patent: Mar. 8, 2022

(54) GOLF CLUB GRIP WITH QUILTED TEXTURE

(71) Applicant: Eaton Intelligent Power Limited, Dublin (IE)

(72) Inventors: Gregory William Cavill, Pinehurst, NC (US); Bruce A. Miller, Pinehurst, NC (US); Craig R. Balnis, Aberdeen, NC (US); James Ledford, Pinehurst, NC (US); Jonathan C. Neal, Davidson, NC (US); Aaron J. Michaud, Fuquay-Varina, NC (US); Alex Lee Walls, Laurinburg, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/944,597

(22) Filed: Jul. 31, 2020

(65) Prior Publication Data

US 2022/0032142 A1 Feb. 3, 2022

(51) Int. Cl.

| | |
|---|---|
| ***A63B 60/08*** | (2015.01) |
| ***A63B 60/14*** | (2015.01) |
| ***A63B 60/16*** | (2015.01) |
| ***A63B 53/14*** | (2015.01) |

(52) U.S. Cl.

CPC ..... *A63B 60/08* (2015.10); *A63B 53/14* (2013.01); *A63B 60/14* (2015.10); *A63B 60/16* (2015.10)

(58) Field of Classification Search

CPC ..... A63B 60/08; A63B 53/14; A63B 60/16; A63B 60/14

USPC ..... 473/300–303; D21/756–759

See application file for complete search history.

(56) References Cited

U.S. PATENT DOCUMENTS

| | | | | |
|---|---|---|---|---|
| 5,398,930 A * | 3/1995 | Gibson | A63B 60/10 473/201 |
| 5,711,720 A * | 1/1998 | Janes | A63B 60/00 473/300 |
| 6,696,659 B1 * | 2/2004 | Wallace | A63B 60/14 219/69.17 |
| D534,605 S * | 1/2007 | Norton | D21/756 |
| D562,924 S * | 2/2008 | DeVaney | D21/756 |
| D595,380 S * | 6/2009 | Koehler | D21/756 |
| D603,921 S * | 11/2009 | Gill | D21/756 |
| D618,296 S * | 6/2010 | Gill | D21/756 |

(Continued)

FOREIGN PATENT DOCUMENTS

WO WO-2010117450 A1 * 10/2010 ..... A41D 19/0003

*Primary Examiner* — Sebastiano Passaniti

(74) *Attorney, Agent, or Firm* — Fay Sharpe LLP

(57) ABSTRACT

A flexible tubular golf club grip is formed of elastomeric material having a substantially closed end with an end cap. The tubular portion is formed of substantially softer material than the end cap and has disposed on opposite sides axially spaced discrete areas of macro-texture having spaced raised portions giving a quilt-like appearance. The discrete areas of macro-texture are disposed peripherally spaced on opposite sides of the grip. The end cap has an extension which closely inter-fits the inner periphery of the tubular portion and provides support therefor proximate the substantially closed end. The cap extension has axially extending protrusions peripherally spaced on the top and bottom of the cap which are flush with the outer surface of the tubular portion.

31 Claims, 5 Drawing Sheets

(56) References Cited

U.S. PATENT DOCUMENTS

| | | | | |
|---|---|---|---|---|
| 8,225,427 | B2 * | 7/2012 | Bevier | A63B 71/148 2/161.6 |
| 8,602,925 | B1 * | 12/2013 | Rickon, Jr. | A63B 60/14 473/568 |
| 10,052,538 | B2 * | 8/2018 | Davis | A63B 60/10 |
| D846,051 | S * | 4/2019 | Davis | D21/756 |
| 2002/0082110 | A1 * | 6/2002 | Chen | A63B 53/14 473/300 |
| 2004/0115397 | A1 * | 6/2004 | Wang | A63B 53/14 428/138 |
| 2006/0287123 | A1 * | 12/2006 | Wang | A63B 60/00 473/300 |
| 2007/0072696 | A1 * | 3/2007 | Chen | A63B 69/3632 473/300 |
| 2008/0167146 | A1 * | 7/2008 | Wu | A63B 53/14 473/549 |
| 2008/0176671 | A1 * | 7/2008 | Chen | A63B 60/00 473/303 |
| 2009/0205105 | A1 * | 8/2009 | Pinkart | A63B 60/08 2/161.3 |
| 2013/0344978 | A1 * | 12/2013 | Huang | A63B 60/14 473/300 |
| 2014/0066222 | A1 * | 3/2014 | Huang | A63B 53/14 473/300 |
| 2015/0059043 | A1 * | 3/2015 | Dwyer | A41D 31/12 2/20 |
| 2016/0271467 | A1 * | 9/2016 | Wallin | A63B 53/14 |
| 2019/0118367 | A1 * | 4/2019 | Davis | B25G 1/01 |
| 2020/0338412 | A1 * | 10/2020 | Takeuchi | A63B 60/14 |

* cited by examiner

GOLF CLUB GRIP WITH QUILTED TEXTURE

BACKGROUND

Upon engaging and focusing on the grip of a golf club, the user senses the secureness of the contact between the user's hands and the grip surface in an effort to minimize the possibility of slippage during the swing. Factors that can influence the performance of the grip making it more or less likely for a player's hands to slip during the swing are coefficient of friction, material hardness, and geometry.

In manufacturing golf club grips, manufacturers have included textural features on the surface of the grip such as grooves and skives, similar to features found on the tread of vehicle tires, which serve to act as channels to control and guide moisture away from the contact areas between the player's hands and the golf club grip. However, the texture of the grip surface can also compromise the available surface area of the grip due to the negative depressions in the surface which can cause voids or air pockets.

Golf grips are manufactured in various predetermined sizes and profiles, with the most common being Men's standard 60R which is a round tapered profile. Heretofore, golf grip designs have included reduced taper profiles which provide a larger overall diameter in the lower half of the grip. Several iterations of this standard size include but are not limited to Mid-size, Jumbo, and Under-size, which may have larger or smaller outer dimensions, dependent on the ergonomic requirements of the golfer.

It has thus been desired to provide an improved golf club grip with a combination of features which improve the "feel" of the grip, in that the coefficient of friction between the player's hands and the grip is maximized yet the amount of pressure required to be applied by the player's hands is minimized while still meeting the required minimum frictional forces that provide the necessary control and security to minimize slippage during the swing.

SUMMARY

The present disclosure includes a tubular elastomeric member having an open end and substantially closed end with an end cap. The flexible golf grip of the present disclosure provides discrete areas of first texture on selected locations of the grip in order to increase the effective surface area of the grip at these locations. The selected discrete areas of the first texture, or macro-texture having a quilted-like appearance, have a pattern of raised rhombic or diamond-shaped projections; and, the discrete areas are configured as axially-spaced arrow-shaped patterns peripherally spaced on the opposite sides of the grip, with the remaining portions or balance of the grip surface having a second texture or micro-texture comprising a pattern of spaced, substantially smaller, depressions.

The location of the quilted texture improves the overall performance of the grip by increasing the effective surface area and the coefficient of friction with minimal pressure on the user's hands and targets specific contact points of the player's hands as denoted in FIG. 1 by reference numeral 11 in the palm and the proximal phalange areas of the fingers denoted by reference numerals 7-10. The arrangement, placement and configuration of the quilted pattern provides reduction in the applied pressure which not only improves comfort but provides improved release on the grip through impact of the club head with the ball without inducing slippage.

The grip of the present disclosure provides an improved feel proximate the substantially closed end of the grip by employing an end cap of elastomeric material significantly harder than the tubular portion of the grip. The end cap has an extension thereon which closely inter-fits with the inner periphery of the grip and provides additional support thereof between the tubular element of the grip and the club shaft. The end cap has axially extending protrusions on the extension which provide peripherally-spaced, on opposite sides of the grip, a reduced area of stiffer or harder durometer elastomeric material thereby improving grip stability and the sense or feel of the grip in the user's hands.

DETAILED DESCRIPTION

Figure 3:
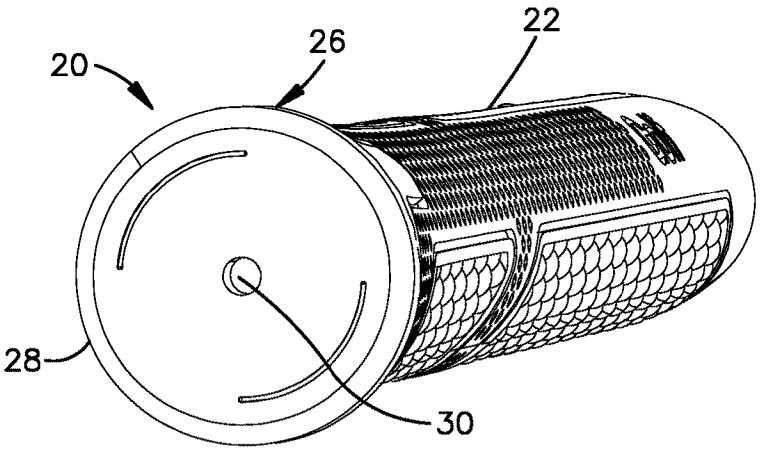
FIG. 3 is a perspective view of the face of the end cap in place on the grip.
Figure 1:
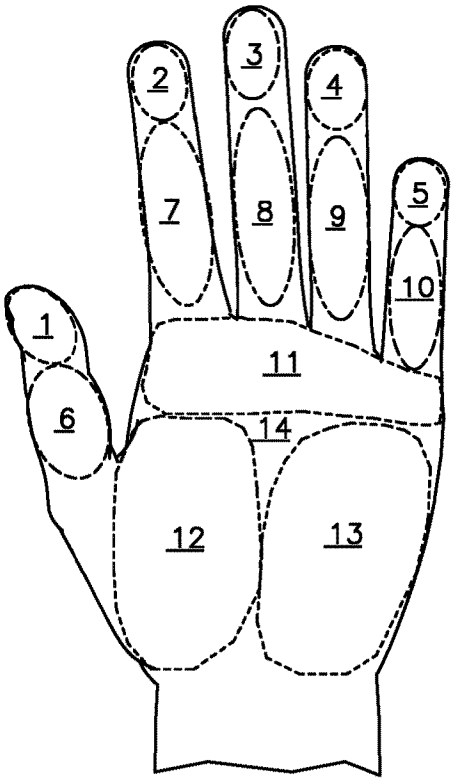
FIG. 1 is a view of a user's hand with various areas of contact with the grip identified by reference numerals 1-13.
Figure 2:
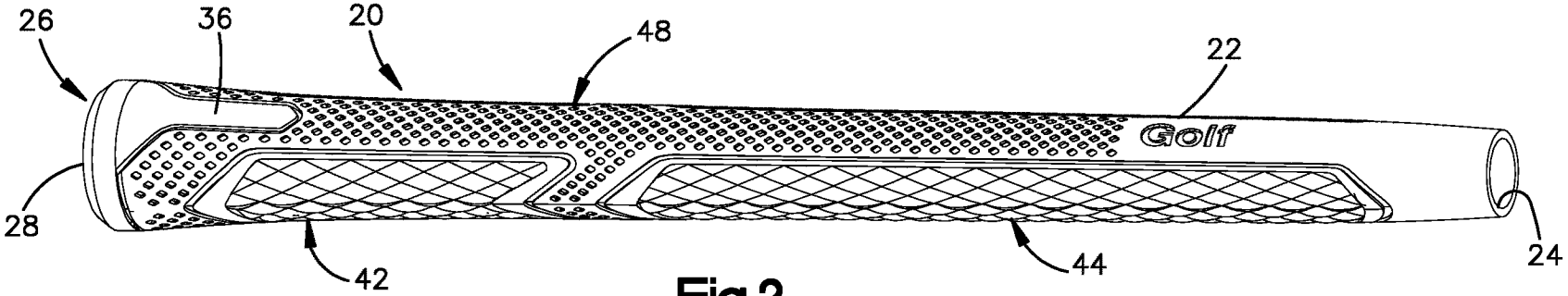
FIG. 2 is a perspective view of the flexible grip of the present disclosure showing the macro-textured or quilted textured areas and the protrusions of the end cap extension appearing on the surface of the grip.

Referring to FIGS. 2 and 3, a flexible grip of the present disclosure is indicated generally at 20 and has an elongated tubular member 22 having a slightly tapered configuration with an open end 24, adapted for being received over a shaft of a golf club, and a substantially closed end indicated generally at 26 with an end cap 28 disposed therein which may have a vent port 30 provided therein. In the present practice of the invention, the tubular member 22 is formed of elastomeric material which may have a hardness or durometer in the range 35-45 on the Shore A scale. The end cap is formed of substantially greater durometer, or hardness, elastomeric material having a durometer in the range 68-78 on the Shore A scale.

Figure 7:
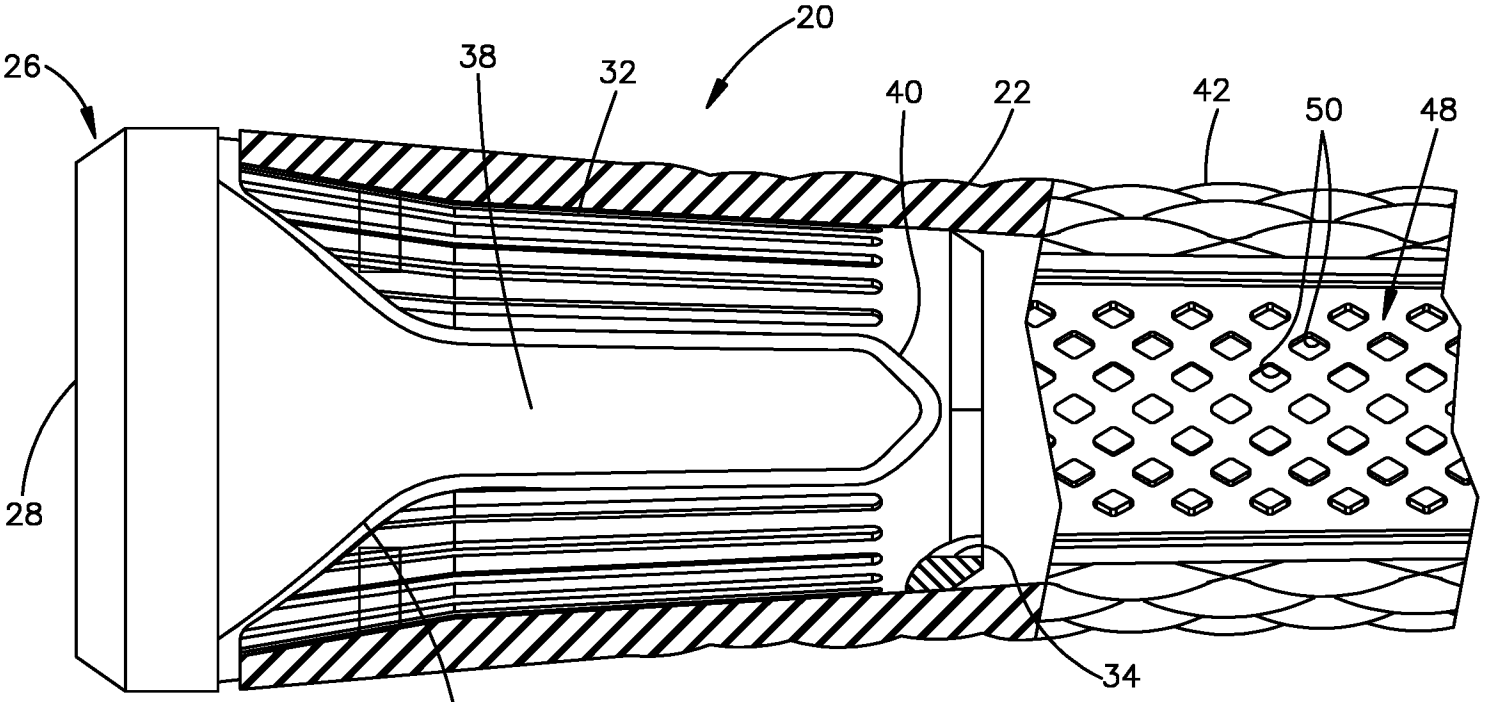
FIG. 7 is an enlarged view of a portion of FIG. 4 with portions of the surface broken away to show the insert portion of the end cap in the interior of the tubular member.

Referring to FIGS. 2 and 7, the end cap 28 is illustrated as having an extension portion 32, which also has a generally tubular configuration, with the outer periphery of wall 34 thereof configured to closely inter-fit with the inner periphery of the tubular member 22 to provide support therefor and to give a firmer feel proximate the substantially closed end of the grip. The extension portion 32 has, on the outer periphery of the wall 34 thereof, a plurality of axially extending protrusions, one of which is shown at 36 in FIG. 7 which protrusions are disposed in peripherally-spaced arrangement and oriented on the end cap to be located oppositely at the top and bottom of the grip. Protrusions 36 are formed on the cap so as to extend radially to the outer surface of the tubular member 22 as shown in FIG. 2, thereby providing an elongated slender region of harder or stiffer elastomeric material in the region proximate the end face of the cap. If desired, indicia 38 may be provided on the outer surface of the protrusions 36 as shown in FIG. 7. If desired, the outline of the protrusions 36 may be bordered by a border depression 40 which may be of a different color than a color of other portions of the tubular member, including the end cap and protrusion 36. If desired, the indicia may have a color different from a color of the plurality of protrusions. If desired, the end cap and protrusions may have a color different from a color of the tubular member.

Figure 4:
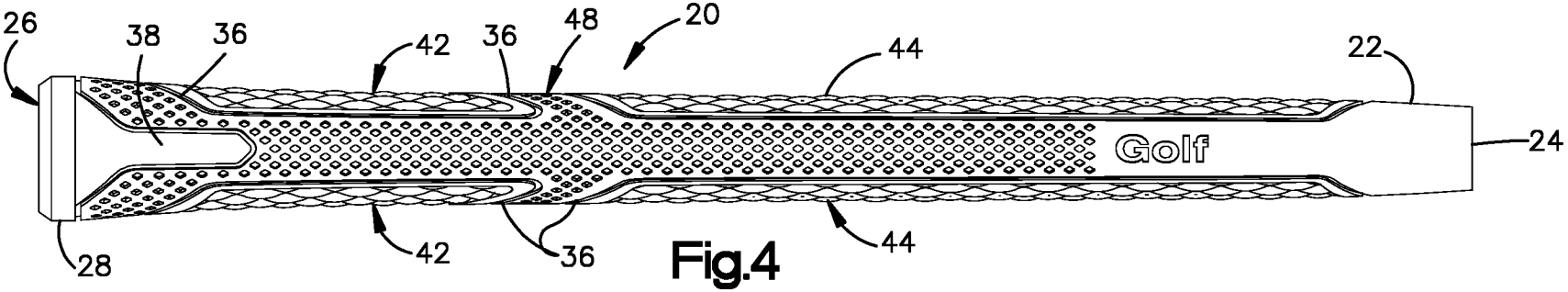
FIG. 4 is a top view of the flexible grip of the present disclosure showing the protrusions of the end cap as they appear on the surface of the grip and the discrete of the pattern of axially-spaced quilted areas.
Figure 5:
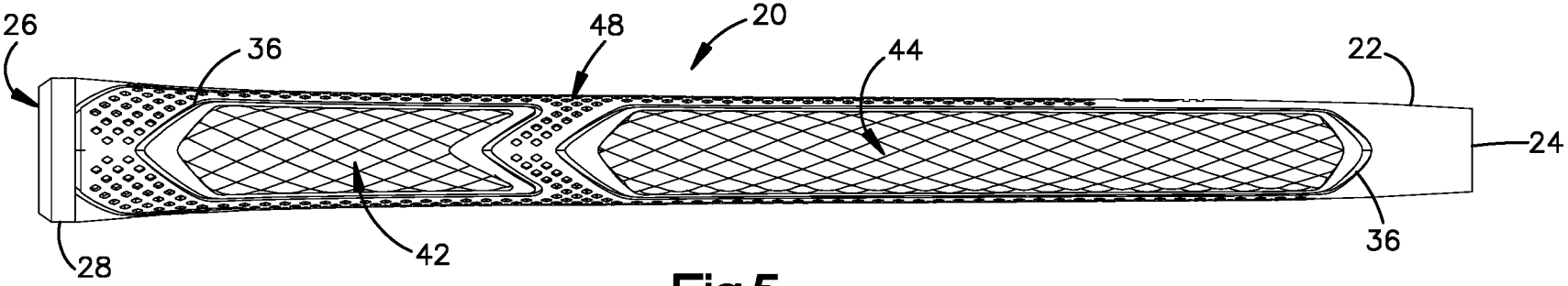
FIG. 5 is a side view of the grip of FIG. 4 showing the configuration of the discrete areas of quilted pattern as they appear on the side of the grip and typically on opposite sides.
Figure 6:
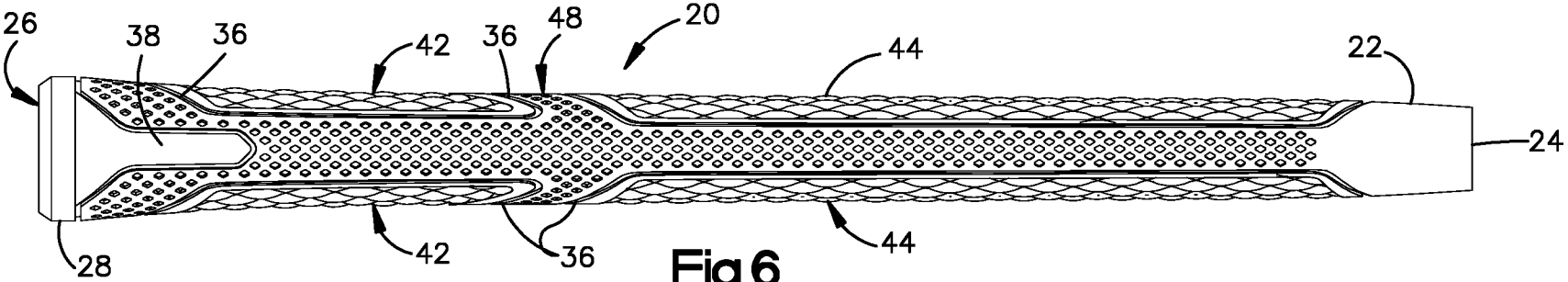
FIG. 6 is a bottom view of the grip of FIG. 4.

Referring to FIGS. 2 and 4-7, the tubular member 22 has a plurality of axially-spaced discrete areas of the first texture indicated generally at 42, 44 which are located on opposite sides of the grip as shown in FIGS. 4-6, it being understood that the discrete areas of pattern of the first texture 42, 44 are repeated on opposite sides of the grip. In the present practice, the discrete areas 42, 44 of the first texture have a generally arrow-shaped configuration or arrow-like appearance as shown in detail in FIGS. 2 and 5. The first texture may be a macro-texture of a quilt-like appearance with a pattern of a plurality of spaced raised portions.

Figure 8:
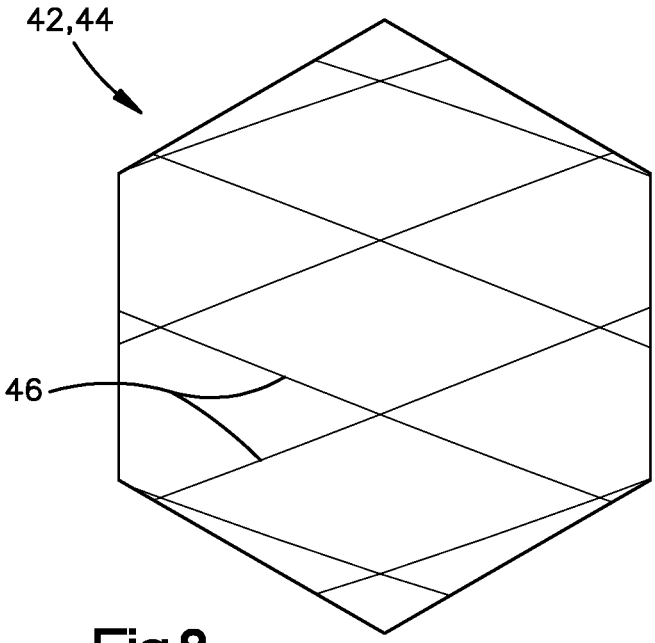
FIG. 8 is an enlarged view of a portion of the discrete areas of the pattern of the macro or quilted texture.
Figure 9:
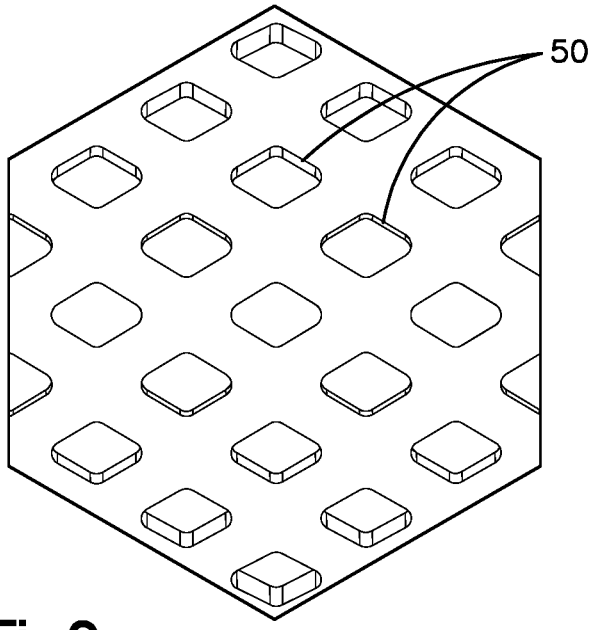
FIG. 9 is an enlarged view of a portion of the micro-texture provided on the remaining portions of the grip surface.
Figure 10:
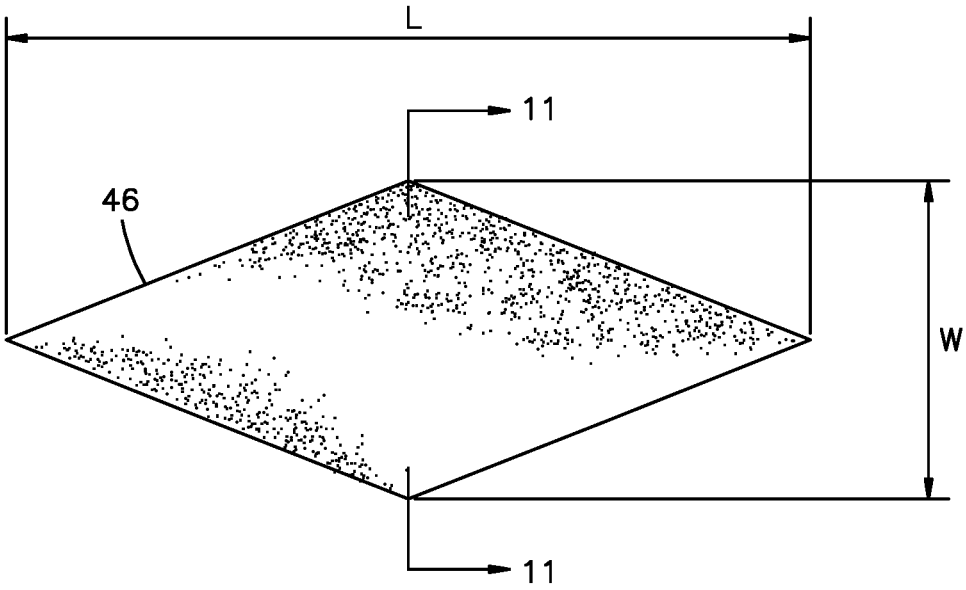
FIG. 10 is an enlarged plan view of one of the pattern of quilted projections of FIG. 8.
Figure 11:
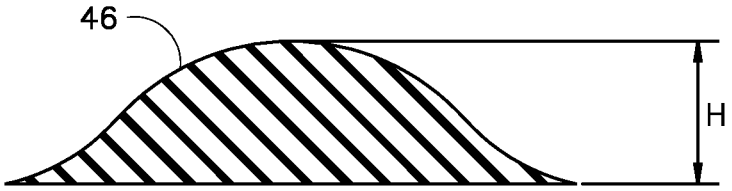
FIG. 11 is a section view taken along section indicating lines 9-9 of FIG. 10.

The macro-texture or quilted pattern of the first texture, shown in enlarged view in FIG. 8, may comprise a pattern of generally rhombic or diamond-shaped protrusions shown in greater detail in FIGS. 10 and 11. In the present practice, it has been found satisfactory to have the raised portions or protrusions 46 formed as denoted to a length L of about 9.7 mm, a width W of about 4.2 mm, and a height H of about 1.0 mm. This arrangement of the raised portions 46 of the discrete areas 42, 44 of quilted or macro-texture thus provides an enhanced grippability by the combination of the softer or lower durometer elastomeric material and the compressibility of the configuration of the rhombic or diamond shape of the raised portions. The appearance of the one of the discrete areas 42 of pattern of quilt-like first texture 42 is also illustrated in greater detail in the enlarged view in FIG. 7.

Referring to FIGS. 2 and 4-7, the remaining portions of the elastomeric tubular member 22 are illustrated as having a second texture or micro-texture denoted generally at 48 and which is comprised of a pattern of spaced depressions indicated typically at 50 which may also have a rhombic configuration but of smaller dimensions and having a depth of about 0.5 mm. In the present practice, it has been found satisfactory to have the discrete areas 42, 44 of the first texture comprise about thirty-seven and a half percent (37.5%) of the total surface area of the flexible grip 10, to provide the optimal amount of comfort and grippability for the user. However, it will be understood that the amount of area of the first texture may be altered if desired to meet performance and grippability requirements. Although the raised portions 46 of the macro-texture or quilted pattern are illustrated as having a rhombic configuration, alternatively other geometric shapes may be employed, as for example, circular domes.

In the present practice, it has been found expedient to form the end cap 28 with the extension 32 and protrusions 36 partially or completely cured or vulcanized in a first mold (not shown). The end cap is then removed from the first mold and placed in another mold and the tubular member 22 formed thereover with the protrusions 36 flush with the outer surface of the tubular member.

The present disclosure describes a flexible grip for a golf club having the tubular portion thereof formed of softer or lower durometer elastomeric material than an end cap which provides a substantially closed end for the grip. The end cap provides support and stiffening of the grip proximate the substantially closed end and has axially extending protrusions on opposite sides which provide a slender area of harder surface in the region proximate the closed end. The tubular member of the grip has a plurality of discrete regions in axially-spaced arrangement disposed on opposite sides of the grip and which have quilted-like appearing texture provided by a pattern of spaced raised portions which may have a rhombic configuration and a height of about 1.0 mm. The remaining portions of the grip tubular member have a micro-texture formed by spaced depressions of about 0.5 mm depth. The discrete areas of quilt-like texture comprise about 37.5% of the surface of the grip and provide increased effective surface area, improved grippability and coefficient of friction with a minimum of manual pressure by the user. The flexible grip of the present disclosure thus provides for increased grippability and comfort to the user and which reduces slippage during the swing which can impair the performance of the swing and impact of the club with the golf ball.

The exemplary embodiment has been described and illustrated with reference to the drawings. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A flexible grip for a golf club shaft comprising:

(a) a tubular member formed of elastomeric material with a substantially closed end and an open end for being received over the shaft;

(b) an end cap received on the tubular member and forming the substantially closed end thereof; and (c) a plurality of distinct areas of texture formed on an outer surface of the tubular member including a first and second distinct area of texture axially spaced on one side of the grip and a third and fourth distinct area of texture axially spaced on an opposite side of the grip 180° opposite to the one side, wherein the first through fourth distinct areas of texture are formed with a first texture and other portions of the outer surface of the grip located circumferentially between the one side and the opposite side are formed of a second texture different than the first texture, wherein the first texture comprises a plurality of spaced raised portions and the second texture comprises a plurality of spaced depressions.

2. The flexible grip of claim 1, wherein the first and second distinct areas of texture are axially aligned and the third and fourth distinct areas of texture are axially aligned.

3. The flexible grip of claim 1, wherein the end cap has a Shore A durometer of about 73 and the tubular member has a Shore A durometer of about 40.

4. The flexible grip of claim 1, wherein the first texture comprises a macro texture, and the second texture comprises a micro texture.

5. The flexible grip of claim 1, wherein the first through fourth distinct areas of texture are each surrounded by a border.

6. The flexible grip of claim 5, wherein the border is formed by a depression.

7. The flexible grip of claim 5, wherein the border has a color different a color of from the other portions of the tubular member.

8. The flexible grip of claim 1, the end cap having integrally formed thereon a plurality of circumferentially spaced protrusions extending axially therefrom wherein the end cap and protrusions have a color different from the other portions of the tubular member.

9. The flexible grip of claim 1, wherein the tubular member has a non-textured surface area proximate the open end and including indicia thereon.

10. The flexible grip of claim 9, wherein the indicia include depressions.

11. The flexible grip of claim 10, wherein the indicia have a color different from the non-textured surface area.

12. The grip of claim 11, wherein the end cap and protrusions have a color different from a color of the tubular member.

13. The grip of claim 1, wherein the protrusions are diametrically opposed.

14. A flexible grip for a golf club shaft comprising:

(a) a tubular member formed of elastomeric material with a substantially closed end and an open end for being received over the shaft;

(b) an end cap received on the tubular member and forming the substantially closed end thereof, wherein the end cap has integrally formed thereon a plurality of circumferentially spaced protrusions extending axially therefrom, the protrusions including indicia, and the indicia including depressions; and (c) a plurality of distinct areas of texture formed on an outer surface of the tubular member including a first and second distinct area of texture axially spaced on one side of the grip and a third and fourth distinct area of texture axially spaced on an opposite side of the grip 180° opposite to the one side, wherein the first through fourth distinct areas of texture are formed with a first texture and other portions of the outer surface of the grip located circumferentially between the one side and the opposite side are formed of a second texture different than the first texture.

15. The flexible grip of claim 14, wherein the indicia have a color different from a color of the plurality of protrusions.

16. A flexible grip for a golf club shaft comprising:

(a) a tubular member formed of elastomeric material with a substantially closed end and an open end for being received over the shaft;

(b) an end cap received on the tubular member and forming the substantially closed end thereof, wherein the end cap has integrally formed thereon a plurality of circumferentially spaced protrusions extending axially therefrom, wherein the protrusions include recessed indicia; and (c) a plurality of distinct areas of texture formed on an outer surface of the tubular member including a first and second distinct area of texture axially spaced on one side of the grip and a third and fourth distinct area of texture axially spaced on an opposite side of the grip 180° opposite to the one side, wherein the first through fourth distinct areas of texture are formed with a first texture and other portions of the outer surface of the grip located circumferentially between the one side and the opposite side are formed of a second texture different than the first texture.

17. The flexible grip of claim 16, wherein the first texture comprises a plurality of spaced raised portions and the second texture comprises a plurality of spaced depressions.

18. The grip of claim 16, wherein the first and second distinct areas of texture include texture formed of spaced raised portions and the other portions include texture formed of spaced depressions.

19. The grip of claim 16 wherein the first and second distinct areas of texture include macro texture and the other portions include micro texture.

20. The grip of claim 16, wherein the first and second distinct areas of texture include texture having a pattern of raised portions and the other portions having a texture comprising a pattern of depressions.

21. The grip of claim 20, wherein the pattern of raised portions includes a pattern of diamond-shaped raised portions.

22. The grip of claim 16, wherein the first and second distinct areas of texture each include a pair of axially spaced and aligned areas.

23. The grip of claim 22, wherein the other portions include a space between the pair of axially spaced and aligned areas.

24. The grip of claim 16, wherein the indicia have a color different from a color of other portions of the protrusions of the end cap.

25. The grip of claim 16, wherein the first and second distinct areas of texture include a pattern of diamond-shaped raised portions.

26. The grip of claim 25, wherein the diamond-shaped raised portions have a length of about 9.7 mm and a width of about 4.2 mm.

27. The grip of claim 25, wherein the diamond-shaped raised portions have a raised height of about 1.0 mm.

28. The grip of claim 16, wherein the second texture of the other portions of the grip includes a pattern of spaced depressions.

29. The grip of claim 28, wherein the pattern of spaced depressions includes diamond-shaped depressions.

30. The grip of claim 16, wherein the first and second distinct areas of texture have a common texture.

31. The grip of claim 16, wherein the first and second distinct areas of texture comprise about thirty-seven and one half percent (37.5%) of a total surface of the tubular member.

* * * * *